US010859055B1

(12) United States Patent
Doering et al.

(10) Patent No.: US 10,859,055 B1
(45) Date of Patent: Dec. 8, 2020

(54) METHOD FOR STARTING AN ENGINE

(71) Applicant: Ford Global Technologies, LLC, Dearborn, MI (US)

(72) Inventors: Jeffrey Allen Doering, Canton, MI (US); Alexander O'Conor Gibson, Ann Arbor, MI (US); Brad Alan VanDerWege, Plymouth, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/551,622

(22) Filed: Aug. 26, 2019

(51) Int. Cl.

| | |
|---|---|
| ***F02N 19/00*** | (2010.01) |
| ***F02M 57/04*** | (2006.01) |
| ***F02N 11/08*** | (2006.01) |
| *F02M 41/14* | (2006.01) |

(52) U.S. Cl.
CPC ..... *F02N 19/004* (2013.01); *F02M 57/04* (2013.01); *F02N 11/0862* (2013.01); *F02M 2041/1472* (2013.01); *F02N 2200/025* (2013.01)

(58) Field of Classification Search
CPC .... F02N 19/00; F02N 19/004; F02N 11/0862; F02N 2200/025; F02M 57/04; F02M 2041/1472
See application file for complete search history.

(56) References Cited

U.S. PATENT DOCUMENTS

| | | | | |
|---|---|---|---|---|
| 6,434,938 | B1 * | 8/2002 | Sun | F02B 37/16 123/90.15 |
| 7,278,388 | B2 | 10/2007 | Lewis et al. | |
| 10,215,106 | B2 * | 2/2019 | Kurtz | F01L 1/344 |
| 2007/0006831 | A1 | 1/2007 | Leone et al. | |
| 2007/0209618 | A1 | 9/2007 | Leone | |

* cited by examiner

*Primary Examiner* — Hieu T Vo
(74) *Attorney, Agent, or Firm* — Geoffrey Brumbaugh; McCoy Russell LLP

(57) ABSTRACT

A method for starting an engine is disclosed. The method may adjust exhaust valve opening timing of one or more cylinders during a first cycle of an engine since a most recent engine stop to reduce engine cranking work. The method may adjust exhaust valve timing if the engine is directly started or started via an electric machine.

20 Claims, 6 Drawing Sheets

METHOD FOR STARTING AN ENGINE

FIELD

The present description relates to methods and a system for starting an engine. The methods and systems may reduce system cost and an amount of energy applied to crank the engine.

BACKGROUND AND SUMMARY

An internal combustion engine of a vehicle may be cranked via an electric machine to facilitate engine starting. The cranking may include rotating the engine at a speed that is less than an engine idle speed while supplying spark and fuel to the engine. Once combustion is initiated in the engine and the engine accelerates to engine idle speed, electrical power that is supplied to the electric machine may be withdrawn. However, the amount of energy that is applied to rotate the engine may vary from engine start to engine start. In particular, the amount of energy applied to start the engine may depend on the position at which the engine stops, engine temperature, and the amount of time that the engine is cranked via the electric machine before combustion in the engine begins to accelerate the engine as well as other engine and vehicle conditions. However, if the engine may be started in a shorter amount of time and by delivering less energy to rotate the engine via the electric machine, it may be possible to reduce the capacity of the electric machine and an amount of energy that is consumed by the electric machine to start the engine.

The inventors herein have recognized the above-mentioned issues and have developed an engine operating method, comprising: adjusting an exhaust valve opening timing of a cylinder of an engine to a crankshaft angle at which a pressure in the cylinder is within a predetermined pressure of a pressure in a crankcase of the engine during engine cranking via a controller in response to an engine start request; and cranking an engine in response to the engine start request.

By adjusting an exhaust valve opening time for a first cycle of a cylinder after a most recent engine stop, it may be possible to provide the technical result of reducing an amount of energy to rotate an engine for starting. In one example, the exhaust valve opening timing for a cylinder may be adjusted to a crankshaft angle at which a pressure in the cylinder is substantially equal (e.g., within ten percent of the engine crankcase pressure) to pressure in an engine crankcase. Opening the exhaust valve of a cylinder at a crankshaft angle at which pressure in the cylinder is substantially equal to pressure in the crankcase allows the engine to be rotated without putting energy into the engine to overcome a vacuum or pressure that may be generated in the cylinder if the exhaust valve were to remain closed.

The present description may provide several advantages. Specifically, the approach may reduce an amount of energy applied to start an engine. The approach may be applied to conditions when the engine is directly started and when an electric machine rotates the engine for starting. In addition, the approach may be applied in many systems at no additional cost. Further still, the approach may enable engine starting with lower torque capacity engine starters and lower capacity electric energy storage devices.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The present description is related to starting an engine and reducing energy to start the engine. The engine may be of the type shown in FIG. 1. The engine may be included in a driveline or powertrain as shown in FIG. 2. The engine may be directly started or the cranking process may be assessed via initiating expansion stroke combustion. Pressure in engine cylinders and torque generated by the cylinders may follow the trajectories shown in FIGS. 3A-4B. Two engine starting sequences are shown in FIG. 5, and the sequence of FIG. 5 may be generated via the method of FIG. 6. In one example, the method of FIG. 6 adjusts exhaust valve timing of a cylinder such that the exhaust valves open at a crankshaft angle where pressure in the cylinder is substantially equal to pressure in the crankcase so that engine cranking torque may be reduced and engine expansion work may be more fully utilized.

Figure 1:
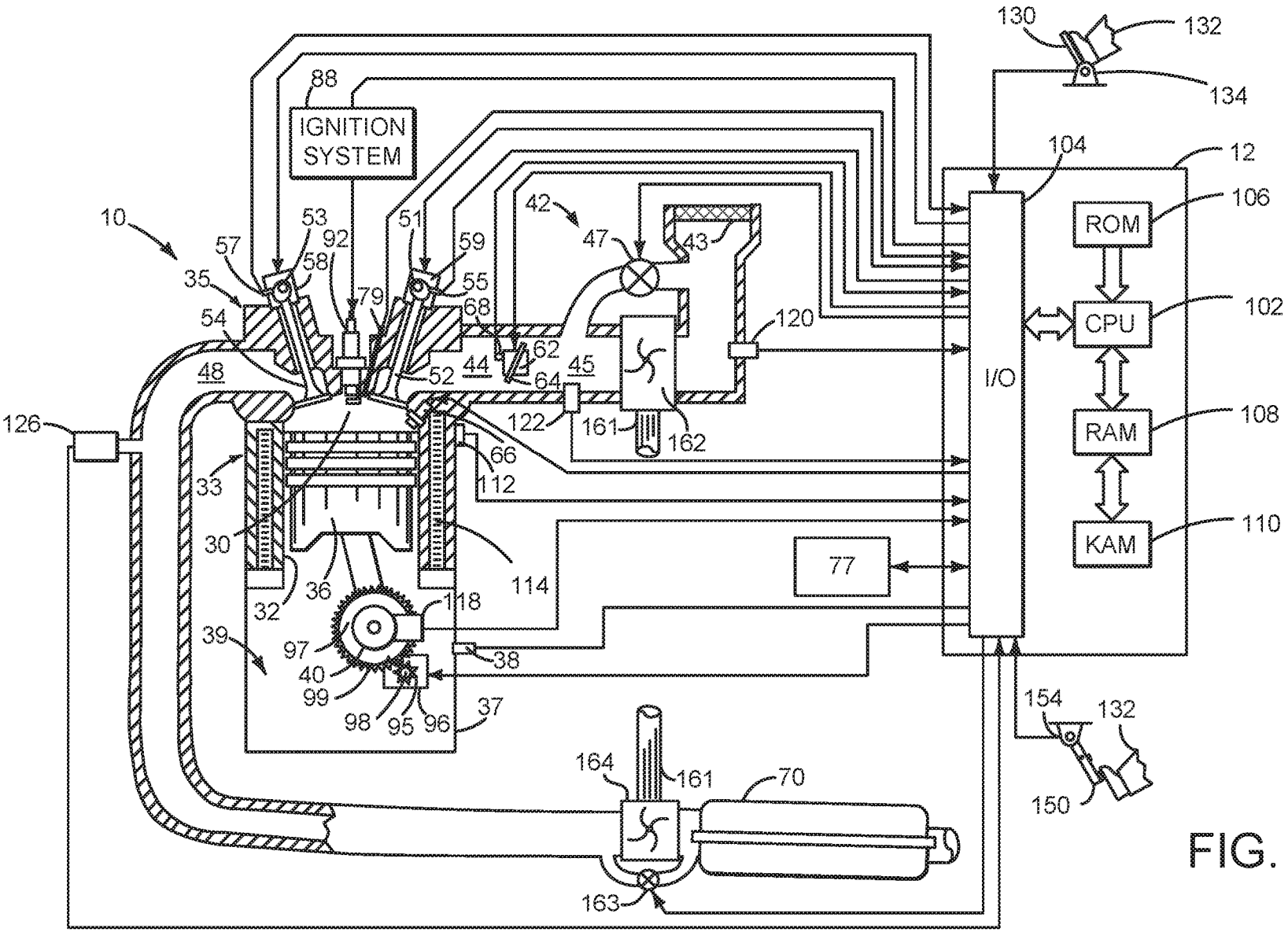
FIG. 1 shows a schematic diagram of an internal combustion engine.
Figure 2:
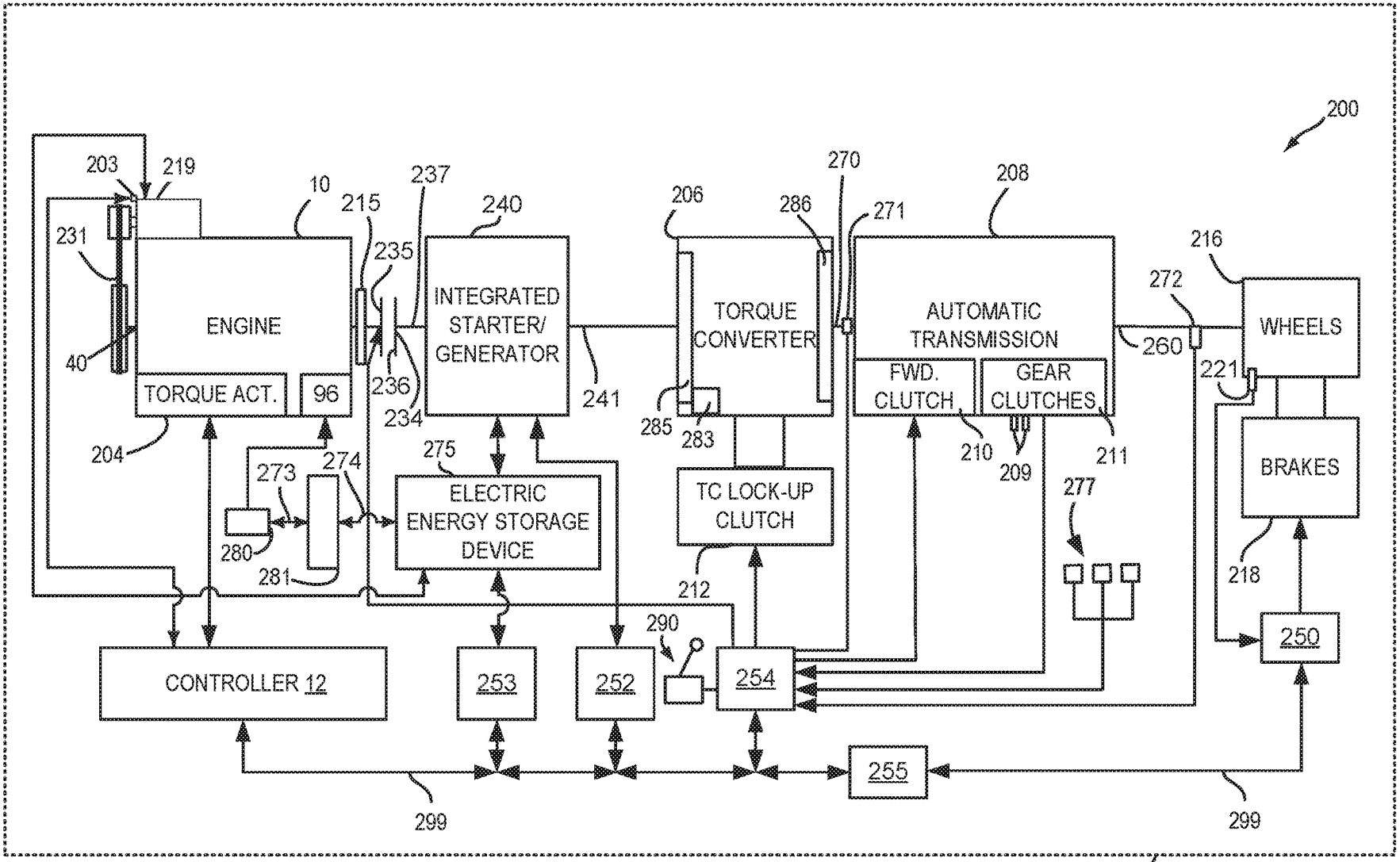
FIG. 2 shows a schematic diagram of a vehicle driveline or powertrain including the internal combustion engine shown in FIG. 1.

Referring to FIG. 1, internal combustion engine 10, comprising a plurality of cylinders, one cylinder of which is shown in FIG. 1, is controlled by electronic engine controller 12. Engine 10 is comprised of cylinder head 35 and block 33, which include combustion chamber 30 and cylinder walls 32. Piston 36 is positioned therein and reciprocates via a connection to crankshaft 40. Flywheel 97 and ring gear 99 are coupled to crankshaft 40. Starter 96 (e.g., low voltage (operated with less than 30 volts) electric machine) includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via a belt or chain. In one example, starter 96 is in a base state when not engaged to the engine crankshaft.

Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57. A phase or position of intake valve 52 may be adjusted relative to a position of crankshaft 40 via valve phase changing device 59. A phase or position of exhaust valve 54 may be adjusted relative to a position of crankshaft 40 via valve phase changing device 58. Valve phase changing devices 58 and 59 may be electro-mechanical devices, hydraulic devices, or mechanical devices.

Engine 10 includes a crankcase 39 that houses crankshaft 40. Oil pan 37 may form a lower boundary of crankcase 39 and engine block 33 and piston 36 may constitute an upper boundary of crankcase 39. Crankcase 39 may include a crankcase ventilation valve (not shown) that may vent gases to combustion chamber 30 via intake manifold 44. Pressure in crankcase 39 may be sensed via pressure sensor 38. Alternatively, pressure in crankcase 39 may be estimated.

Fuel injector 66 is shown positioned to inject fuel directly into cylinder 30, which is known to those skilled in the art as direct injection. Fuel injector 66 delivers liquid fuel in proportion to the pulse width from controller 12. Fuel is delivered to fuel injector 66 by a fuel system (not shown) including a fuel tank, fuel pump, and fuel rail (not shown). In one example, a high pressure, dual stage, fuel system may be used to generate higher fuel pressures.

In addition, intake manifold 44 is shown communicating with turbocharger compressor 162 and engine air intake 42. In other examples, compressor 162 may be a supercharger compressor. Shaft 161 mechanically couples turbocharger turbine 164 to turbocharger compressor 162. Optional electronic throttle 62 adjusts a position of throttle plate 64 to control air flow from compressor 162 to intake manifold 44. Pressure in boost chamber 45 may be referred to a throttle inlet pressure since the inlet of throttle 62 is within boost chamber 45. The throttle outlet is in intake manifold 44. In some examples, throttle 62 and throttle plate 64 may be positioned between intake valve 52 and intake manifold 44 such that throttle 62 is a port throttle. Compressor recirculation valve 47 may be selectively adjusted to a plurality of positions between fully open and fully closed. Waste gate 163 may be adjusted via controller 12 to allow exhaust gases to selectively bypass turbine 164 to control the speed of compressor 162. Air filter 43 cleans air entering engine air intake 42.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a position sensor 154 coupled to brake pedal 150 for sensing force applied by foot 152, a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; cylinder pressure from pressure sensor 79; and a measurement of throttle position from sensor 68. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

Controller 12 may also receive input from human/machine interface 77. In one example, human/machine interface 77 may be a display panel. Alternatively, human/machine interface 77 may be a key switch or other known type of human/machine interface. Human/machine interface 77 may receive requests from a user. For example, a user may request an engine stop or start via human/machine interface 77. Additionally, human/machine interface 77 may display status messages and engine data that may be received from controller 77.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion.

During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

FIG. 2 is a block diagram of a vehicle 225 including a powertrain or driveline 200. The powertrain of FIG. 2 includes engine 10 shown in FIG. 1. Powertrain 200 is shown including vehicle system controller 255, engine controller 12, electric machine controller 252, transmission controller 254, energy storage device controller 253, and brake controller 250. The controllers may communicate over controller area network (CAN) 299. Each of the controllers may provide information to other controllers such as power output limits (e.g., power output of the device or component being controlled not to be exceeded), power input limits (e.g., power input of the device or component being controlled not to be exceeded), power output of the device being controlled, sensor and actuator data, diagnostic information (e.g., information regarding a degraded transmission, information regarding a degraded engine, information regarding a degraded electric machine, information regarding degraded brakes). Further, the vehicle system controller 255 may provide commands to engine controller 12, electric machine controller 252, transmission controller 254, and brake controller 250 to achieve driver input requests and other requests that are based on vehicle operating conditions.

For example, in response to a driver releasing an accelerator pedal and vehicle speed, vehicle system controller 255 may request a desired wheel power or a wheel power level to provide a desired rate of vehicle deceleration. The requested desired wheel power may be provided by vehicle system controller 255 requesting a first braking power from electric machine controller 252 and a second braking power from engine controller 212, the first and second powers providing a desired driveline braking power at vehicle wheels 216. Vehicle system controller 255 may also request a friction braking power via brake controller 250. The braking powers may be referred to as negative powers since they slow driveline and wheel rotation. Positive power may maintain or accelerate driveline and wheel rotation.

In other examples, the partitioning of controlling powertrain devices may be partitioned differently than is shown in FIG. 2. For example, a single controller may take the place of vehicle system controller 255, engine controller 12, electric machine controller 252, transmission controller 254, and brake controller 250. Alternatively, the vehicle system controller 255 and the engine controller 12 may be a single unit while the electric machine controller 252, the transmission controller 254, and the brake controller 250 are standalone controllers.

In this example, powertrain 200 may be powered by engine 10 and electric machine 240. In other examples, engine 10 may be omitted. Engine 10 may be started with an engine starting system shown in FIG. 1, via BISG 219, or via driveline integrated starter/generator (ISG) 240 also known as an integrated starter/generator. A speed of BISG 219 may be determined via optional BISG speed sensor 203. Driveline ISG 240 (e.g., high voltage (operated with greater than 30 volts) electrical machine) may also be referred to as an electric machine, motor, and/or generator. Further, power of engine 10 may be adjusted via power actuator 204, such as a fuel injector, throttle, etc.

BISG is mechanically coupled to engine 10 via belt 231. BISG may be coupled to crankshaft 40 or a camshaft (e.g., 51 or 53 of FIG. 1). BISG may operate as a motor when supplied with electrical power via electric energy storage device 275 or low voltage battery 280. BISG may operate as a generator supplying electrical power to electric energy storage device 275 or low voltage battery 280. Bi-directional DC/DC converter 281 may transfer electrical energy from a high voltage buss 274 to a low voltage buss 273 or vice-versa. Low voltage battery 280 is electrically coupled to low voltage buss 273. Electric energy storage device 275 is electrically coupled to high voltage buss 274. Low voltage battery 280 selectively supplies electrical energy to starter motor 96.

An engine output power may be transmitted to an input or first side of powertrain disconnect clutch 235 through dual mass flywheel 215. Disconnect clutch 236 may be electrically or hydraulically actuated. The downstream or second side 234 of disconnect clutch 236 is shown mechanically coupled to ISG input shaft 237.

ISG 240 may be operated to provide power to powertrain 200 or to convert powertrain power into electrical energy to be stored in electric energy storage device 275 in a regeneration mode. ISG 240 is in electrical communication with energy storage device 275. ISG 240 has a higher output power capacity than starter 96 shown in FIG. 1 or BISG 219. Further, ISG 240 directly drives powertrain 200 or is directly driven by powertrain 200. There are no belts, gears, or chains to couple ISG 240 to powertrain 200. Rather, ISG 240 rotates at the same rate as powertrain 200. Electrical energy storage device 275 (e.g., high voltage battery or power source) may be a battery, capacitor, or inductor. The downstream side of ISG 240 is mechanically coupled to the impeller 285 of torque converter 206 via shaft 241. The upstream side of the ISG 240 is mechanically coupled to the disconnect clutch 236. ISG 240 may provide a positive power or a negative power to powertrain 200 via operating as a motor or generator as instructed by electric machine controller 252.

Torque converter 206 includes a turbine 286 to output power to input shaft 270. Input shaft 270 mechanically couples torque converter 206 to automatic transmission 208. Torque converter 206 also includes a torque converter bypass lock-up clutch 212 (TCC). Power is directly transferred from impeller 285 to turbine 286 when TCC is locked. TCC is electrically operated by controller 254. Alternatively, TCC may be hydraulically locked. In one example, the torque converter may be referred to as a component of the transmission.

When torque converter lock-up clutch 212 is fully disengaged, torque converter 206 transmits engine power to automatic transmission 208 via fluid transfer between the torque converter turbine 286 and torque converter impeller 285, thereby enabling power multiplication. In contrast, when torque converter lock-up clutch 212 is fully engaged, the engine output power is directly transferred via the torque converter clutch to an input shaft 270 of transmission 208. Alternatively, the torque converter lock-up clutch 212 may be partially engaged, thereby enabling the amount of power directly relayed to the transmission to be adjusted. The transmission controller 254 may be configured to adjust the amount of power transmitted by torque converter 212 by adjusting the torque converter lock-up clutch in response to various engine operating conditions, or based on a driver-based engine operation request.

Torque converter 206 also includes pump 283 that pressurizes fluid to operate disconnect clutch 236, forward clutch 210, and gear clutches 211. Pump 283 is driven via impeller 285, which rotates at a same speed as ISG 240.

Automatic transmission 208 includes gear clutches (e.g., gears 1-10) 211 and forward clutch 210. Automatic transmission 208 is a fixed ratio transmission. Alternatively, transmission 208 may be a continuously variable transmission that has a capability of simulating a fixed gear ratio transmission and fixed gear ratios. The gear clutches 211 and the forward clutch 210 may be selectively engaged to change a ratio of an actual total number of turns of input shaft 270 to an actual total number of turns of wheels 216. Gear clutches 211 may be engaged or disengaged via adjusting fluid supplied to the clutches via shift control solenoid valves 209. Power output from the automatic transmission 208 may also be relayed to wheels 216 to propel the vehicle via output shaft 260. Specifically, automatic transmission 208 may transfer an input driving power at the input shaft 270 responsive to a vehicle traveling condition before transmitting an output driving power to the wheels 216. Transmission controller 254 selectively activates or engages TCC 212, gear clutches 211, and forward clutch 210.

Transmission controller also selectively deactivates or disengages TCC 212, gear clutches 211, and forward clutch 210.

Further, a frictional force may be applied to wheels 216 by engaging friction wheel brakes 218. In one example, friction wheel brakes 218 may be engaged in response to a human driver pressing their foot on a brake pedal (not shown) and/or in response to instructions within brake controller 250. Further, brake controller 250 may apply brakes 218 in response to information and/or requests made by vehicle system controller 255. In the same way, a frictional force may be reduced to wheels 216 by disengaging wheel brakes 218 in response to the human driver releasing their foot from a brake pedal, brake controller instructions, and/or vehicle system controller instructions and/or information. For example, vehicle brakes may apply a frictional force to wheels 216 via controller 250 as part of an automated engine stopping procedure.

In response to a request to accelerate vehicle 225, vehicle system controller may obtain a driver demand power or power request from an accelerator pedal or other device. Vehicle system controller 255 then allocates a fraction of the requested driver demand power to the engine and the remaining fraction to the ISG or BISG. Vehicle system controller 255 requests the engine power from engine controller 12 and the ISG power from electric machine controller 252. If the ISG power plus the engine power is less than a transmission input power limit (e.g., a threshold value not to be exceeded), the power is delivered to torque converter 206 which then relays at least a fraction of the requested power to transmission input shaft 270. Transmission controller 254 selectively locks torque converter clutch 212 and engages gears via gear clutches 211 in response to shift schedules and TCC lockup schedules that may be based on input shaft power and vehicle speed. In some conditions when it may be desired to charge electric energy storage device 275, a charging power (e.g., a negative ISG power) may be requested while a non-zero driver demand power is present. Vehicle system controller 255 may request increased engine power to overcome the charging power to meet the driver demand power.

In response to a request to decelerate vehicle 225 and provide regenerative braking, vehicle system controller may provide a negative desired wheel power (e.g., desired or requested powertrain wheel power) based on vehicle speed and brake pedal position. Vehicle system controller 255 then allocates a fraction of the negative desired wheel power to the ISG 240 and the engine 10. Vehicle system controller may also allocate a portion of the requested braking power to friction brakes 218 (e.g., desired friction brake wheel power). Further, vehicle system controller may notify transmission controller 254 that the vehicle is in regenerative braking mode so that transmission controller 254 shifts gears 211 based on a unique shifting schedule to increase regeneration efficiency. Engine 10 and ISG 240 may supply a negative power to transmission input shaft 270, but negative power provided by ISG 240 and engine 10 may be limited by transmission controller 254 which outputs a transmission input shaft negative power limit (e.g., not to be exceeded threshold value). Further, negative power of ISG 240 may be limited (e.g., constrained to less than a threshold negative threshold power) based on operating conditions of electric energy storage device 275, by vehicle system controller 255, or electric machine controller 252. Any portion of desired negative wheel power that may not be provided by ISG 240 because of transmission or ISG limits may be allocated to engine 10 and/or friction brakes 218 so that the desired wheel power is provided by a combination of negative power (e.g., power absorbed) via friction brakes 218, engine 10, and ISG 240.

Accordingly, power control of the various powertrain components may be supervised by vehicle system controller 255 with local power control for the engine 10, transmission 208, electric machine 240, and brakes 218 provided via engine controller 12, electric machine controller 252, transmission controller 254, and brake controller 250.

As one example, an engine power output may be controlled by adjusting a combination of spark timing, fuel pulse width, fuel pulse timing, and/or air charge, by controlling throttle opening and/or valve timing, valve lift and boost for turbo- or super-charged engines. In the case of a diesel engine, controller 12 may control the engine power output by controlling a combination of fuel pulse width, fuel pulse timing, and air charge. Engine braking power or negative engine power may be provided by rotating the engine with the engine generating power that is insufficient to rotate the engine. Thus, the engine may generate a braking power via operating at a low power while combusting fuel, with one or more cylinders deactivated (e.g., not combusting fuel), or with all cylinders deactivated and while rotating the engine. The amount of engine braking power may be adjusted via adjusting engine valve timing. Engine valve timing may be adjusted to increase or decrease engine compression work. Further, engine valve timing may be adjusted to increase or decrease engine expansion work. In all cases, engine control may be performed on a cylinder-by-cylinder basis to control the engine power output. Electric machine controller 252 may control power output and electrical energy production from ISG 240 by adjusting current flowing to and from field and/or armature windings of ISG as is known in the art.

Transmission controller 254 receives transmission input shaft position via position sensor 271. Transmission controller 254 may convert transmission input shaft position into input shaft speed via differentiating a signal from position sensor 271 or counting a number of known angular distance pulses over a predetermined time interval. Transmission controller 254 may receive transmission output shaft torque from torque sensor 272. Alternatively, sensor 272 may be a position sensor or torque and position sensors. If sensor 272 is a position sensor, controller 254 may count shaft position pulses over a predetermined time interval to determine transmission output shaft velocity. Transmission controller 254 may also differentiate transmission output shaft velocity to determine transmission output shaft acceleration. Transmission controller 254, engine controller 12, and vehicle system controller 255, may also receive addition transmission information from sensors 277, which may include but are not limited to pump output line pressure sensors, transmission hydraulic pressure sensors (e.g., gear clutch fluid pressure sensors), ISG temperature sensors, and BISG temperatures, gear shift lever sensors, and ambient temperature sensors. Transmission controller 254 may also receive requested gear input from gear shift selector 290 (e.g., a human/machine interface device). Gear shift selector 290 may include positions for gears 1-N (where N is an upper gear number), D (drive), and P (park).

Brake controller 250 receives wheel speed information via wheel speed sensor 221 and braking requests from vehicle system controller 255. Brake controller 250 may also receive brake pedal position information from brake pedal sensor 154 shown in FIG. 1 directly or over CAN 299. Brake controller 250 may provide braking responsive to a wheel power command from vehicle system controller 255. Brake controller 250 may also provide anti-lock and vehicle stability braking to improve vehicle braking and stability. As such, brake controller 250 may provide a wheel power limit (e.g., a threshold negative wheel power not to be exceeded) to the vehicle system controller 255 so that negative ISG power does not cause the wheel power limit to be exceeded. For example, if controller 250 issues a negative wheel power limit of 50 N-m, ISG power is adjusted to provide less than 50 N-m (e.g., 49 N-m) of negative power at the wheels, including accounting for transmission gearing.

Figure 3A:
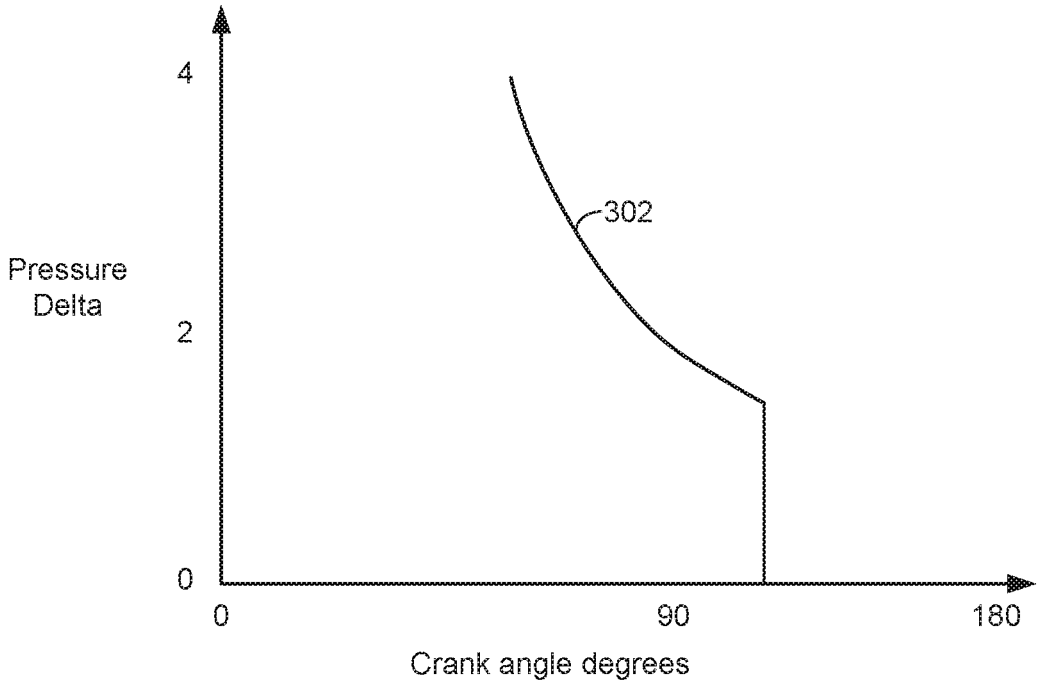
FIGS. 3A-4B show plots of cylinder pressure delta and torque delta during expansion combustion.

Thus, the system of FIGS. 1 and 2 provides for a vehicle system, comprising: an engine; and a controller including executable instructions stored in non-transitory memory to adjust an exhaust valve opening timing of a cylinder of the engine to a crankshaft angle at which a pressure in the cylinder is expected to be within a predetermined pressure of a pressure in a crankcase of the engine when combustion does not occur in the cylinder before a first exhaust stroke of the cylinder after a most recent engine stop. The vehicle system further comprises additional instructions to crank the engine via an electric machine. The vehicle system further comprises additional instructions to measure a pressure in the crankcase. The vehicle system further comprises additional instructions to estimate the pressure in the crankcase. Referring now to FIG. 3A, a plot of cylinder pressure delta versus crankshaft angle is shown. The vertical axis represents a pressure difference between pressure in a cylinder when expansion combustion is present and pressure in the cylinder when expansion combustion is not present. The horizontal axis represents crankshaft angle relative to top-dead-center compression stroke (e.g., 0 crankshaft degrees) and bottom-dead-center exhaust stroke (e.g., 180 crankshaft degrees) of the cylinder with the delta pressure. Trace 302 represents the cylinder pressure delta, which may be expressed as:

$$\text{delta_}p(\theta)=\text{Cyl_}p\text{_expan}(\theta)-\text{Cyl_}p(\theta)$$

where delta p is the cylinder pressure difference, Cyl_p_expan is cylinder pressure when there is expansion combustion in the cylinder, e is the crankshaft angle, and Cyl_p is cylinder pressure when there is no combustion in the cylinder.

At sixty crankshaft degrees after top-dead-center compression stroke, the pressure delta is at its highest level when expansion combustion is first initiated and the cylinder volume is small. It should be noted that sixty crankshaft degrees after top-dead-center compression stroke is merely an example starting position and other crankshaft angles may be referenced as the initial position. As the engine begins to rotate due to the expansion combustion, the pressure delta declines until the exhaust valve opens at 120 crankshaft degrees after top-dead-center compression stroke of the cylinder. The delta pressure falls to zero when the exhaust valve opens. In this sequence, beginning at expansion combustion at 60 crankshaft after top-dead-center compression stroke and ending at 120 crankshaft degrees after top-dead-center compression stroke, 68.5 Joules of work is input to the engine crankshaft via the torque generated from expansion combustion as compared to when there is no expansion combustion in the cylinder.

Figure 3B:
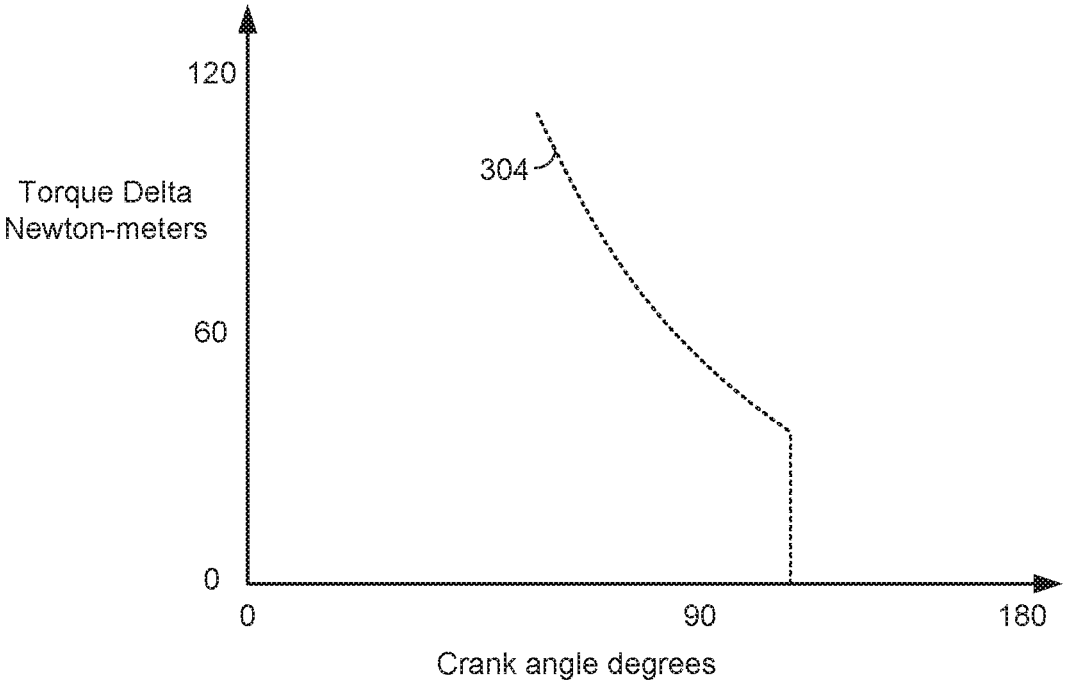

Referring now to FIG. 3B, a plot of cylinder torque delta versus crankshaft angle is shown. The vertical axis represents a torque difference between torque generated via the cylinder when expansion combustion is present and torque generated via the cylinder when expansion combustion is not present. The horizontal axis represents crankshaft angle relative to top-dead-center compression stroke (e.g., 0 crankshaft degrees) and bottom-dead-center exhaust stroke (e.g., 180 crankshaft degrees) of the cylinder with the delta pressure. Trace 304 represents the cylinder torque delta, which may be expressed as:

$$\text{delta_}t(\theta)=\text{Cyl_}t\text{_expan}(\theta)-\text{Cyl_}t(\theta)$$

where delta t is the cylinder torque difference, Cyl_t_expan is cylinder torque generated when there is expansion combustion in the cylinder, e is the crankshaft angle, and Cyl_t is cylinder torque generated when there is no combustion in the cylinder. The torque displayed in FIG. 3B corresponds to the cylinder described in FIG. 3A and it is related to the delta pressure displayed in FIG. 3A.

At 60 crankshaft degrees after top-dead-center compression stroke, the torque delta is at its highest level when expansion combustion is first initiated and the cylinder volume is small. As the engine begins to rotate due to the expansion combustion, the torque delta declines until the exhaust valve opens at 120 crankshaft degrees after top-dead-center compression stroke of the cylinder. The delta torque falls to zero when the exhaust valve opens. Thus, the delta cylinder pressure and delta cylinder torque follow similar trajectories for early exhaust valve opening timing.

Figure 4A:
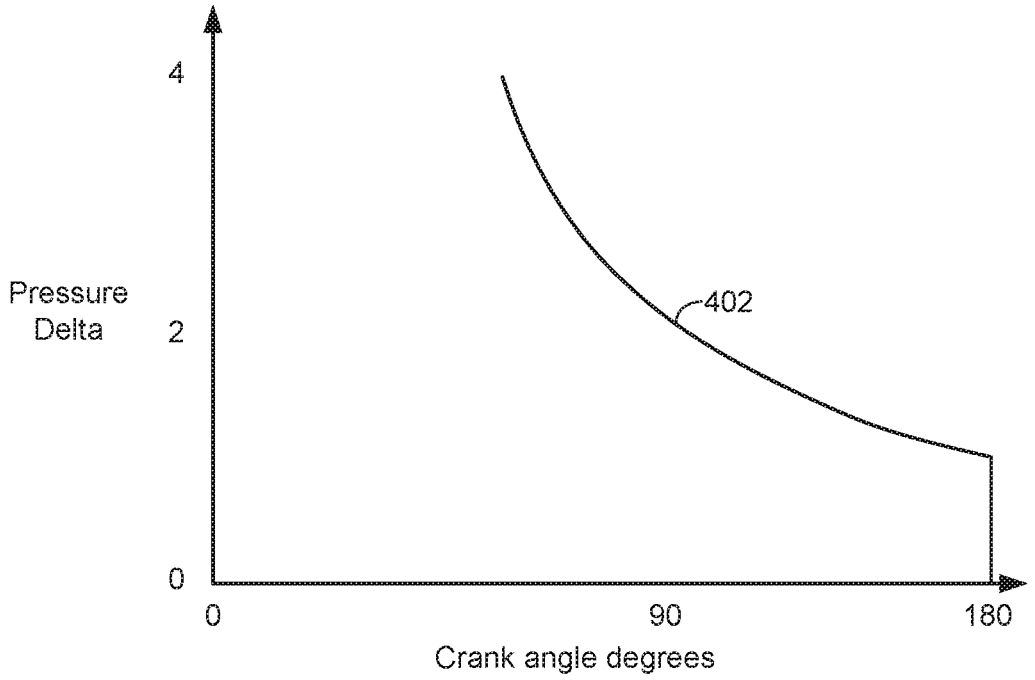
Figure 5:
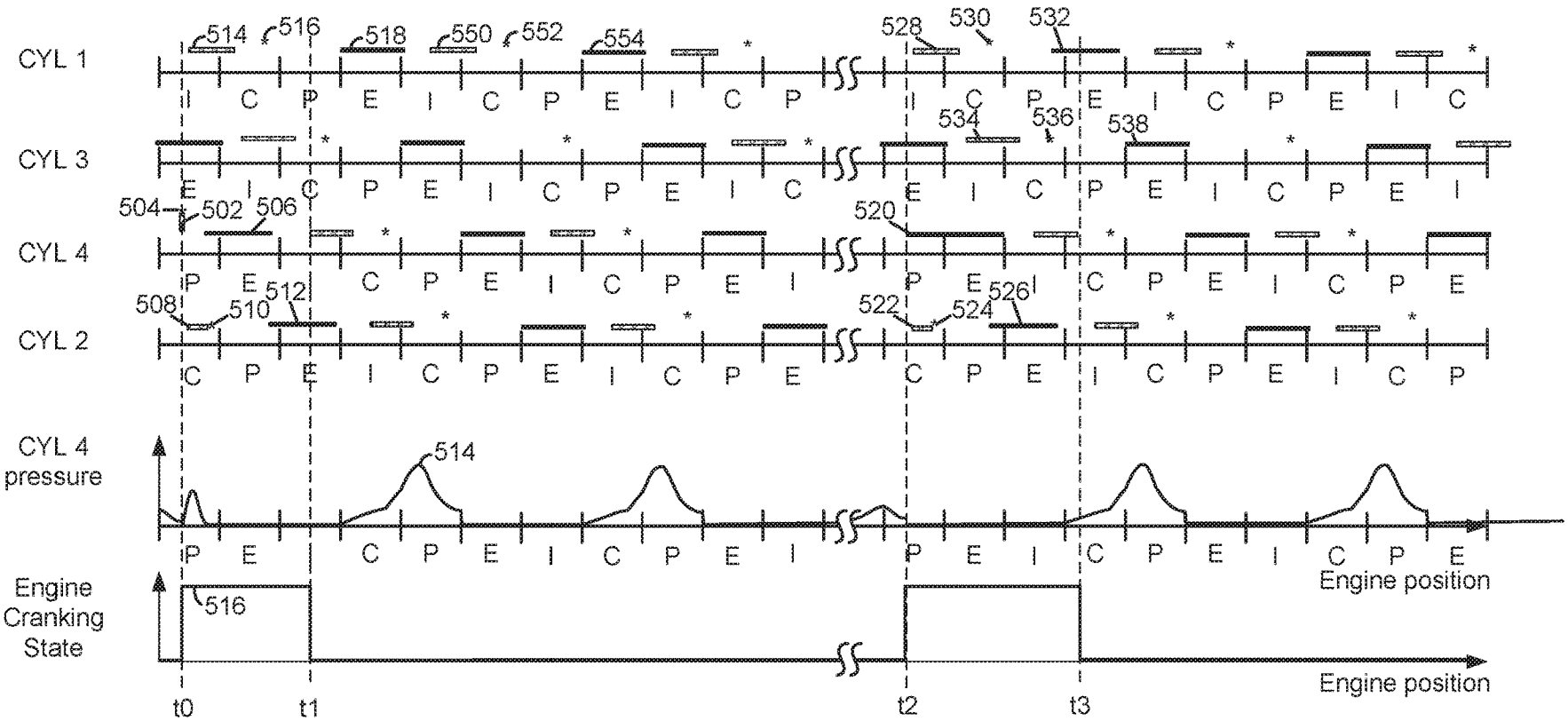
FIG. 5 shows plots of prophetic engine starts.

Referring now to FIG. 4A, a second plot of cylinder pressure delta versus crankshaft angle is shown. The vertical axis represents a pressure difference between pressure in a cylinder when expansion combustion is present and pressure in the cylinder when expansion combustion is not present. The horizontal axis represents crankshaft angle relative to top-dead-center compression stroke (e.g., 0 crankshaft degrees) and bottom-dead-center exhaust stroke (e.g., 180 crankshaft degrees) of the cylinder with the delta pressure. Trace 402 represents the cylinder pressure delta. However, in this example, the exhaust valve opening timing is delayed and it occurs later than the exhaust valve opening timing shown in FIGS. 3A and 3B.

At 60 crankshaft degrees after top-dead-center compression stroke, the pressure delta is at its highest level when expansion combustion is first initiated and the cylinder volume is small. As the engine begins to rotate due to the expansion combustion, the pressure delta declines until the exhaust valve opens at 180 crankshaft degrees after top-dead-center compression stroke of the cylinder. The delta pressure falls to zero when the exhaust valve opens. In this sequence, beginning at expansion combustion at 60 crankshaft after top-dead-center compression stroke and ending at 180 crankshaft degrees after top-dead-center compression stroke, 83.5 Joules of work is input to the engine crankshaft via the torque generated from expansion combustion as compared to when there is no expansion combustion in the cylinder. Thus, by delaying the exhaust valve opening, the pressure in the cylinder may perform additional work as compared to the exhaust valve timing shown in FIGS. 3A and 3B.

Figure 4B:
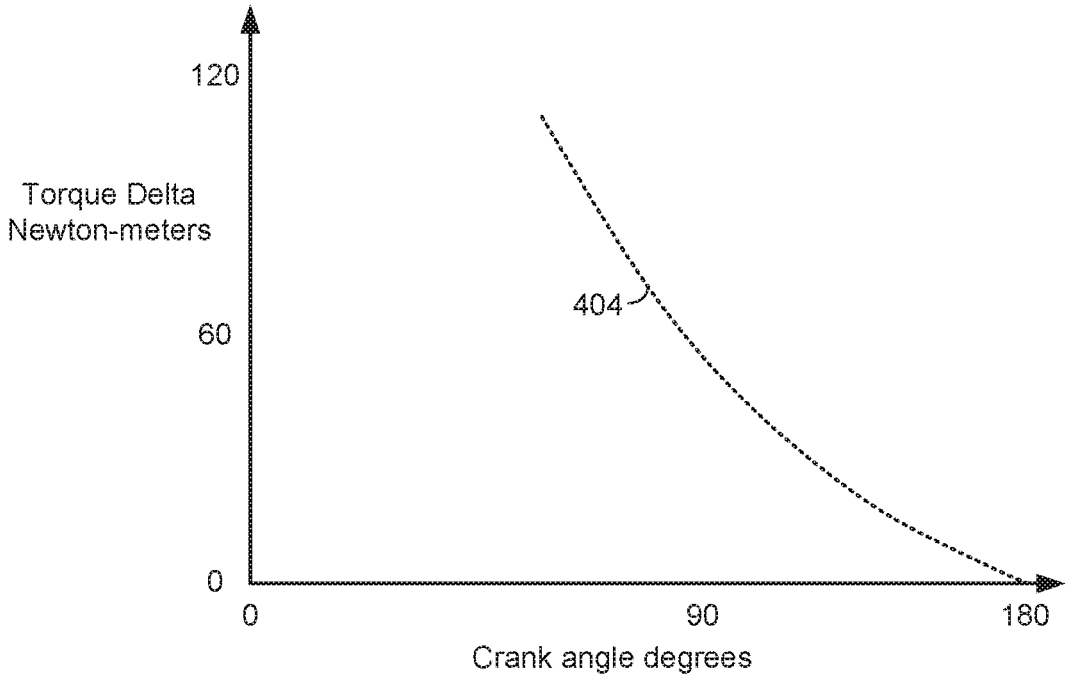

Referring now to FIG. 4B, a plot of cylinder torque delta versus crankshaft angle is shown. The vertical axis represents a torque difference between torque generated via the cylinder when expansion combustion is present and torque generated via the cylinder when expansion combustion is not present. The horizontal axis represents crankshaft angle relative to top-dead-center compression stroke (e.g., 0 crankshaft degrees) and bottom-dead-center exhaust stroke (e.g., 180 crankshaft degrees) of the cylinder with the delta pressure. Trace 404 represents the cylinder torque delta.

At sixty crankshaft degrees after top-dead-center compression stroke, the torque delta is at its highest level when expansion combustion is first initiated and the cylinder volume is small. As the engine begins to rotate due to the expansion combustion, the torque delta declines until the exhaust valve opens at 180 crankshaft degrees after top-dead-center compression stroke of the cylinder. The delta torque is nearly zero before reaching 180 crankshaft degrees. Therefore, if the exhaust valve is not opened at 180 crankshaft degrees, then the delta torque may turn negative after 180 crankshaft degrees. Thus, work put into rotating the engine, whether the work is generated via chemical energy or electric energy, may be reduced via adjusting exhaust valve opening timing for a predetermined number of engine combustion events after a most recent engine stop (e.g., no combustion and no engine rotation).

Referring now to FIG. 5, two example prophetic engine starting sequences are shown. The starting sequences may be provided by the system of FIGS. 1 and 2 according to the method of FIG. 6. The first engine starting sequence begins at time t0 and the second engine starting sequence begins at time t2. The SS marks along the horizontal axes of the plots are breaks in time and the break may be long or short in duration. The vertical lines represent times of interest in the sequence. In this example, the engine is a four stroke four cylinder engine having a firing order of 1-3-4-2. Times of interest are indicated by the vertical lines at time t0-t3. The sequence moves from left to right.

The first plot from the top of FIG. 5 is a plot of strokes of cylinder number one. The vertical bars represent top-dead-center and bottom-dead-center positions for cylinder number one. Intake stroke is indicated by "I" and compression stroke is indicated by "C." The power or expansion stroke is indicated by "P" and the exhaust stroke is indicated by "E." Exhaust valve timing is indicated by a solid bar as shown at 554. The exhaust valves are open at the timings indicated by the solid bars (e.g., 554) and closed at engine positions where the solid bars are not shown. Spark timing is indicated by "*" as shown at 552 and fuel injection timing is indicated by a hatched bar as shown at 550. Spark is present at the crankshaft angle indicated by the "*" and spark is not present at crankshaft angles where the "*" is not shown. Fuel injection is occurring at crankshaft angles where hatched bars (e.g., 550) are present and fuel injection is not occurring at crankshaft angles where hatched bars are not present. The same notations for spark, fuel injection, and exhaust valve timing are used in the first four plots from the top of FIG. 5.

The second plot from the top of FIG. 5 is a plot of strokes cylinder number three. The spark timings, exhaust valve timings, and fuel injection timings are indicated in a similar way that they were indicated in the first plot from the top of FIG. 5.

The third plot from the top of FIG. 5 is a plot of strokes cylinder number four. The spark timings, exhaust valve timings, and fuel injection timings are indicated in a similar way that they were indicated in the first plot from the top of FIG. 5.

The fourth plot from the top of FIG. 5 is a plot of strokes cylinder number two. The spark timings, exhaust valve timings, and fuel injection timings are indicated in a similar way that they were indicated in the first plot from the top of FIG. 5.

The fifth plot from the top of FIG. 5 is a plot of pressure in cylinder number four versus cylinder position of cylinder number four. The vertical axis represents cylinder pressure in cylinder number four and the cylinder pressure increases in the direction of the vertical axis arrow. The horizontal axis represents the present stroke that cylinder number four is on. Trace 514 represents pressure in cylinder number four.

The sixth plot from the top of FIG. 5 is a plot of engine cranking state versus the cylinder stroke of cylinder number four. The vertical axis represents engine cranking state and the engine is not being cranked or rotated under power of an electric machine when trace 516 is at a lower level near the horizontal axis. The engine is being cranked under power of an electric machine when trace 516 is at a higher level near the vertical axis arrow. Trace 516 represents the engine cranking state.

The engine is fully stopped (e.g., not rotating) at time t0 and the engine may be stopped for a long or short duration. Pressure in the cylinder will be reduced to be equal to engine crankcase pressure after the engine is fully stopped for a short (approximately 1 second) amount of time. In this example, cylinder number four is on its power or expansion stroke when the engine is stopped. It is determined by the controller that expansion combustion may be useful for starting the engine. Fuel is injected to cylinder number four while the engine is not rotating as indicated at 502, then the fuel is combusted via a spark as indicated at 504. The combusted fuel increases pressure in cylinder number four between time t0 and time t1. The increased pressure in the cylinder causes the engine to begin to rotate. In this example, the engine starter advances the starter pinion to engage the engine a predetermined amount of time before the spark is delivered to cylinder number four. The starter is engaged to assist engine starting. Since expansion combustion is initiated in cylinder number four, a reduced amount of electrical power may be delivered to the starter motor to rotate the engine, thereby conserving electrical energy that is delivered to the starter motor. Alternatively, a BISG or starter/generator or a disconnect clutch may begin to apply torque to rotate the engine beginning at the time spark is delivered to cylinder number four.

The exhaust valve opening timing as indicated by bar 506 is advanced from bottom-dead-center exhaust stroke to a timing and crankshaft angle at which pressure in cylinder number four is expected or determined to be substantially equal to pressure in the engine's crankcase (e.g., the pressure in the cylinder is within 10% of pressure in the engine crankcase). Since the amount of air in the cylinder at time t0 is a function of the volume of cylinder number four at that time, the amount of fuel that is injected into cylinder number four at time t0 to make a lean, rich (preferred) or stoichiometric air-fuel ratio in cylinder number four is based on the estimated trapped air mass in cylinder number four at time t0. The amount of air and fuel that is combusted in the cylinder may affect the crankshaft angle at which pressure in the cylinder is substantially equal to pressure in the engine crankcase. In this example, the crankshaft angle at which the cylinder pressure in cylinder number four is equal to engine crankcase pressure after expansion combustion in cylinder number four occurs at the opening timing of exhaust valve timing bar 506 (e.g., the left side of bar 506). In this example, cylinder number four is the first cylinder in which expansion stroke combustion is initiated after the engine is stopped at time t0. This timing is advanced from bottom-dead-center exhaust stroke of cylinder number four.

Once engine rotation begins, fuel injection to cylinder number two begins. Cylinder number two is the next cylinder in the order of combustion after time t0. Fuel injection for a second combustion event (e.g., combustion of air and fuel) since the most recent engine stop at time t0 is indicated by hatch bar 508. As the engine rotates spark is delivered to cylinder number two as indicated at 510. The exhaust valve opening timing for cylinder number two is advanced of bottom-dead-center exhaust stroke of cylinder number two so that the exhaust valve of cylinder number two open when pressure in cylinder number two is substantially equal to crankcase pressure in the engine. In this example, the pressure in cylinder number two is substantially equal to crankcase pressure at a crankshaft angle that is advanced from bottom-dead-center of the exhaust stroke of cylinder number two as indicated by bar 512.

Fuel is injected into cylinder number one while combustion is occurring in cylinder number two as indicated by hatch bar 514. The fuel that is injected as indicated by hatch bar 514 is combusted beginning in the compression stroke of cylinder number one as indicated at 516. The combustion initiated at 516 is the third combustion event since the most recent engine stop at time t0. The engine continues to accelerate due to combustion and torque that is applied to the crankshaft via the starter motor.

At time t1, the electric power that is delivered to the starter motor is stopped. The electric power that is delivered to the starter motor may be stopped in response to engine speed exceeding a threshold speed. The exhaust valve timing in cylinder number one is adjusted to a base exhaust valve timing that may be a function of engine speed and engine load in response to electric power being withdrawn from the starter motor. Since the starter is no longer cranking the engine, the exhaust valve timing may be adjusted to reduce engine emissions and improve combustion stability. The base exhaust valve timing is indicated by the bar at 518. In addition, the exhaust valve timings of each cylinder are adjusted to their respective base timings in response to electric power being withdrawn from the starter since adjusting valve timing may reduce engine emissions and since electric power to rotate the starter no longer may no longer be conserved. The engine proceeds to run up and then it eventually stops.

The engine is stopped at a same location that the engine stopped previously at time t2, except for this engine start expansion combustion is not determined to be viable. Therefore, at time t2, the starter is engaged and expansion combustion is not initiated. Since the pressure in cylinder number two is substantially equal to engine crankcase pressure at time t2, the exhaust valves of cylinder number two are opened, which allows the engine to rotate without creating a vacuum in cylinder number two. Therefore, electrical energy need not be used to create vacuum in cylinder number two that may not provide useful benefit. The exhaust valve timing for cylinder number two is indicated by bar 520 and its duration is extended so that work to crank the engine may be reduced. Fuel injection into cylinder number two begins shortly after the engine begins to rotate as indicated by hatch bar 522. However, since pressure in cylinder number two may be reduced if air passes the piston when the engine is stopped, the amount of fuel that is injected into cylinder number two is smaller than if cylinder number two had been completely filled with air at the cylinder's greatest volume. The air-fuel mixture in cylinder number two is combusted via spark delivered as shown at 524. The exhaust valve timing of cylinder number two is advanced to a crankshaft angle where cylinder pressure is expected to equal engine crankcase pressure as indicated by solid bar 526.

Fuel is also injected to cylinder number one as the engine is rotated via the starter as indicated by hatch bar 528. The fuel that is injected into cylinder number one is combusted as indicated at 530. The exhaust valve opening timing for cylinder number one is advanced from bottom-dead-center exhaust stroke as shown by solid bar 532. The exhaust valves for cylinder number one are opened at a crankshaft angle where cylinder pressure is expected to be substantially equal to crankcase pressure.

Fuel is injected a third time to the engine since the most recent engine stop (e.g., the engine is not rotating) at time t2 into cylinder number three as indicated by hatch bar 534. A first combustion event in cylinder number three since the most recent engine stop is initiated as indicated at 536. The combustion causes the engine to accelerate and then electrical power is removed from the starter at time t3 to conserve electric power. Since the starter is no longer rotating the engine, exhaust valve timings for the cylinders is adjusted (e.g., retarded) to a base exhaust valve timing that is based on engine speed and engine load after time t3.

In this way, exhaust valve timing may be adjusted to reduce an amount of electric energy that is used to crank an engine during engine starting. Further, exhaust valve timing may be adjusted in response to the electric power being withdrawn from the starter so that engine emissions and combustion stability may be improved.

Figure 6:
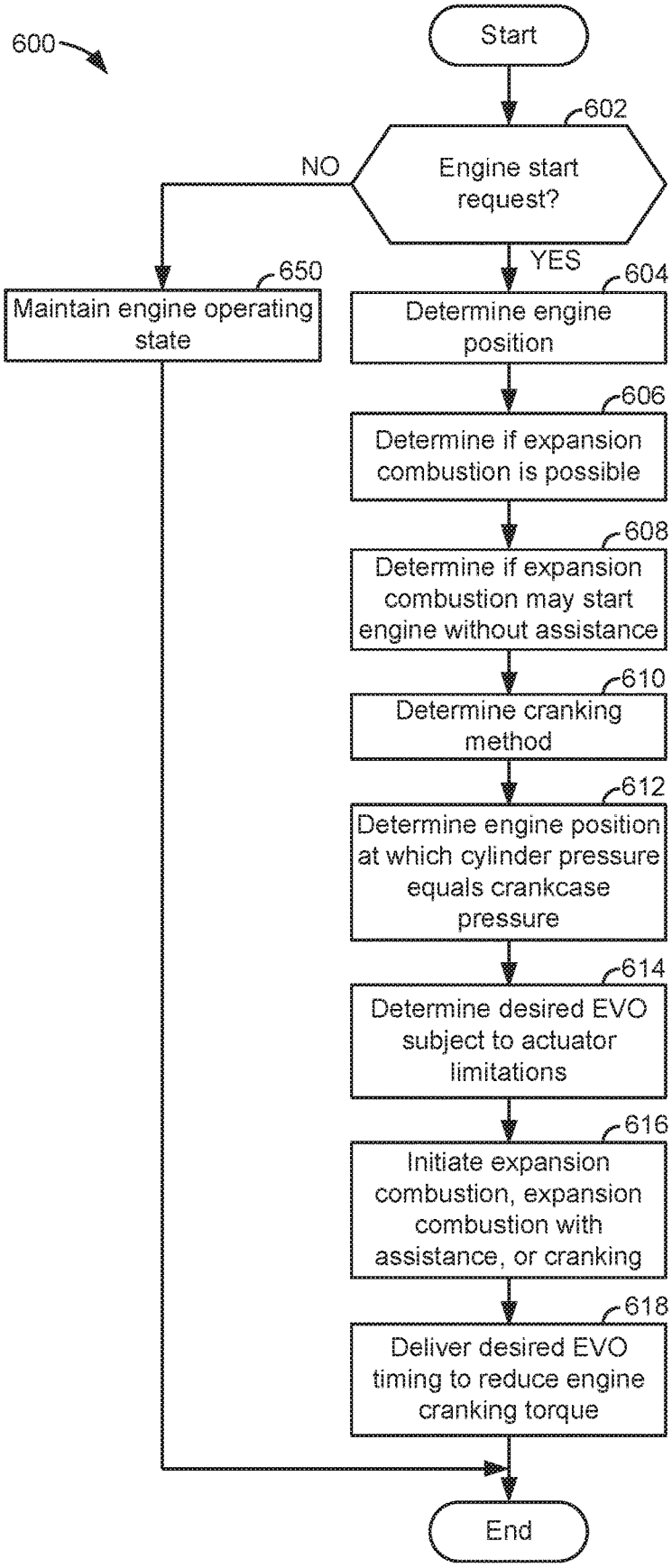
FIG. 6 shows an example method for operating an engine.

Referring now to FIG. 6, a method for operating an engine is shown. At least portions of method 600 may be implemented as executable controller instructions stored in non-transitory memory. Method 600 may operate in cooperation with the system of FIGS. 1 and 2. Additionally, portions of method 600 may be actions taken in the physical world to transform an operating state of an actuator or device. The method of FIG. 6 may be incorporated into the system of FIGS. 1 and 2 as executable instructions stored in non-transitory memory.

At 602, method 600 judges whether or not an engine start is requested. An engine start may be requested via input to a human/machine interface (e.g., key switch or display panel). If method 600 judges that an engine start is requested, the answer is yes and method 600 proceeds to 604. Otherwise, the answer is no and method 600 may proceed to 650.

At 650, method 600 maintains or adjusts engine operation according to an engine operating state. For example, method 600 may adjust fuel injection, intake and exhaust valve timing, and spark timing to base timings that are responsive to engine speed and engine load. Further, method 600 may adjust engine operation according to a driver demand torque. In particular, engine spark timing, engine intake and exhaust valve timing, and engine fuel injection timing may be adjusting in response to a driver demand torque or an accelerator pedal position. Method 600 proceeds to exit.

At 604, method 600 determines the position of the engine when the engine is fully stopped (e.g., not rotating). The engine position may be determined via the engine position sensor and the engine position may be stored to memory at the time that the engine stops rotating. In addition, method 600 may determine other engine operating conditions such as engine temperature, ambient temperature, fuel pressure, etc. Method 600 proceeds to 606 after the engine position is determined.

At 606, method 600 determines if expansion combustion (e.g., combustion that is initiated in a cylinder that is on the cylinder's expansion stroke via injecting fuel to the cylinder and combusting an air-fuel mixture in the cylinder that is on its expansion stroke when the engine is not rotating). In one example, method 600 may input engine operating conditions into logic that determines whether or not expansion combustion may start the engine without rotating the engine via an electric machine (e.g., starter motor, ISG, BISG, or integrated starter/generator). The same logic may also determine if the engine is to be started without expansion combustion. Expansion combustion may be inhibited during conditions where expansion combustion increases engine emissions or during conditions where expansion combustion may provide fewer benefits. For example, engine temperature, ambient temperature, fuel temperature, and engine stopping position may be input to the logic and the logic may output a requested engine starting procedure that includes cranking the engine via an electric machine without expansion combustion, starting the engine without cranking the engine via the electric machine and with expansion combustion, or starting the engine via expansion combustion and rotating the engine via the electric machine. In one example, method 600 may determine whether or not expansion combustion may start the engine according to the following expression:

$$Exp_com=fn_exp(eng_pos,eng_t,bp,fp,crk_meth)$$

where Exp_com is a variable that indicates whether or not expansion combustion may start the engine, fn_exp is a function that returns a value, eng_pos is a variable that represents engine present engine position, eng_t is a variable that represents present engine temperature, bp is present barometric pressure, fp is present fuel pressure, and crk_meth is a variable that represents the engine cranking method (e.g., starter, ISG, BISG, integrated starter generator, or expansion combustion). The function fn_exp may be tables or functions that are referenced via the previously mentioned variables and the tables or functions output a variable that is indicative of whether or not expansion combustion may start the engine at present engine operating conditions. The values in the tables and/or functions may be empirically determined and stored in controller memory. Method 600 proceeds to 610 after it is determined if expansion combustion may start the engine.

At 610, method 600 determines an engine cranking method if at step 608 that the engine is to be cranked (e.g., rotated) via an electric machine. Method 600 may select an engine cranking method based on the battery state of charge, states of electric machines, and engine operating conditions including engine stopping position. In one example, the battery state of charge, states of electric machines, and engine operating conditions including engine stopping position are input into logic and the logic outputs a desired engine craning method (e.g., ISG, starter, BISG, integrated starter/generator). Method 600 proceeds to 612.

At 612, method 600 estimates the engine position that pressures in engine cylinders will be substantially equal to engine crankcase pressure. In one example, method 600 estimates an engine position at which pressure in an engine cylinder will be equal to engine crankcase pressure. Method may estimate the position pressure in an engine cylinder will be equal to engine crankcase pressure via the following equations:

$$Eq_pr_loc=fn_loc(eng_st_pos,bp,Ex_com,PP_exp,CR_atm)$$

$$PP_exp=fn_exp(bp,rot_com,Comb_qual,eng_st_pos,spk_tm)$$

where Eq_pr_loc is the crankshaft angle location where pressure in the cylinder is expected or estimated to be equal to engine crankcase pressure, fn_loc is a function that returns an engine crankshaft angle, eng_st_pos is the position at which the engine is stopped and not rotating, bp is barometric pressure, Ex_com is a variable representing whether or not expansion combustion is used to start the engine, PP_exp is location of peak cylinder pressure if expansion combustion is used to start the engine, and CR_atm is the engine crankshaft angle where cylinder pressure is expected to be atmospheric pressure. The engine stopping position may be the basis for adjusting the exhaust valve opening timing as a function of a volume of the cylinder or piston position at the engine stopping position. In addition, fn_exp is a function that returns the estimated or expected crankshaft angle of peak cylinder pressure, rot_com is a variable that indicates whether the engine is rotated before expansion combustion is initiated, Comb_qual is a variable that represents combustion quality, and spk_tm is the spark timing relative to end of fuel injection timing for the cylinder in which expansion combustion is being initiated. Method 600 proceeds to 614.

At 614, method 600 determines a desired exhaust valve opening (EVO) subject to exhaust valve actuator limitations. For example, if the exhaust valve actuator is fast acting and may open and close the exhaust valve independent of engine position (e.g., an electrically actuated valve or a hydraulically actuated valve), then method 600 may open the exhaust valve at the crankshaft angle Eq_pr_loc. However, if the exhaust valve is mechanically actuated and may open within 10 crankshaft degrees of Eq_pr_loc, then method 600 may schedule exhaust valve opening to be within 10 crankshaft degrees of Eq_pr_loc. In one example, available exhaust valve opening timings that are based on exhaust valve actuator type may be stored in controller memory locations and the controller may select an available exhaust valve opening that is closest to the value of Eq_pr_loc. Method 600 proceeds to 616 after the desired exhaust valve opening location is determined.

At 616, method 600 initiates expansion combustion in one or more cylinders that are presently in their expansion stroke when the engine is not rotating. In particular, one cylinder is selected to be a first cylinder since a most recent engine stop in which combustion occurs, and the combustion is expansion combustion. The expansion combustion process includes injecting fuel to a cylinder and delivering a spark in the cylinder a predetermined amount of time after fuel delivery to the cylinder begins. The amount of fuel injected is based on an estimated amount of air that is trapped in the cylinder and the air-fuel mixture may be stoichiometric or lean of stoichiometric. The amount of air in the cylinder may be estimated based on volume of the cylinder and pressure in the cylinder. The spark may be delivered to the cylinder while fuel is being injected to the cylinder (e.g., near end of injection timing), at end of fuel injection timing, or a predetermined amount of time after end of fuel injection timing for the cylinder that is experiencing expansion combustion. The expansion combustion may move the piston in the cylinder in which expansion combustion is initiated or it may assist moving the piston in the cylinder while an electric machine applies torque to a crankshaft to move the piston. Once expansion combustion is initiated in one or more cylinders with pistons that are not moving at the beginning of expansion combustion, then subsequent cylinders in which pistons are moving may receive injected fuel and spark to sustain combustion in the engine and accelerate the engine. Examples of the same are shown in FIG. 5.

In some examples, where an electric machine is assisting crankshaft rotation, the electric machine may begin applying torque to the engine crankshaft at substantially the same time as spark is delivered to the cylinder that is undergoing expansion combustion. Further, if the electric machine is a starter motor, the starter pinion may be commanded to engage the flywheel and ring gear a predetermined amount of time before spark is delivered to the cylinder that is undergoing expansion combustion so that the electric machine may timely assist rotating the crankshaft in an effort to provide a smooth engine start and starter engagement. The predetermined time may be a function of engine temperature, barometric pressure, fuel rail pressure, engine position, or fuel rail temperature. For example, if it takes 100 milliseconds to advance a starter pinion shaft so that a pinion gear engages a ring gear, then method 600 may advance the starter pinion shaft 100 milliseconds before spark is delivered to the cylinder that is undergoing expansion combustion. Method 600 proceeds to 618 after expansion combustion is initiated and the engine crankshaft begins to move.

Additionally, combustion is initiated in other cylinders of the engine after expansion combustion is initiated in a first cylinder of the engine in which combustion occurs after a most recent engine stop. However, combustion in the other cylinders is not expansion combustion unless the engine stops with two cylinders in their respective expansion strokes. Rather, combustion in other cylinders begins during compression strokes of the other cylinders via supplying spark to these cylinders in their respective compression strokes.

At 618, method 600 opens the exhaust valve of the cylinder or cylinders that are undergoing expansion combustion at the desired exhaust valve opening timing or crankshaft angle as determined at 614 via the exhaust valve actuator. Alternatively, method 600 may open the exhaust valve when pressure measured in a cylinder is substantially equal to (e.g., within 10%) a pressure measured in an engine crankcase. In some examples, method 600 may open exhaust valves of a cylinder when pressure in the cylinder is within a predetermined pressure in a crankcase of an engine. In addition, method 600 may open exhaust valves of cylinders that are not undergoing expansion compression at crankshaft locations where pressure in the cylinder is substantially equal to pressure in the engine crankcase to reduce the amount of work to rotate the engine, thereby improving energy utilization. The exhaust valves may be opened with such timing until the electric machine does not apply torque to rotate the engine or until engine speed is equal to a threshold speed, which may be an indication that the engine is started and base valve timing may be desired. Method 600 proceeds to exit.

In this way, exhaust valve opening timing may be adjusted to reduce work to crank the engine during engine starting. Further, the exhaust valves may be opened at crankshaft angles where pressure in a cylinder is substantially equal to pressure in a crankcase so that power to rotate the engine may be conserved by not generating excess vacuum or pressure in engine cylinders.

Thus, the method of FIG. 6 provides for an engine operating method, comprising: adjusting an exhaust valve opening timing of a cylinder of an engine to a crankshaft angle at which a pressure in the cylinder is within a predetermined pressure of a pressure in a crankcase of the engine during engine cranking via a controller in response to an engine start request; and cranking an engine in response to the engine start request. The method includes where the predetermined pressure is a pressure within ten percent of the pressure in the crankcase. The method includes where the engine is cranked via a starter motor. The method includes where the engine is cranked via an integrated starter/generator. The method further comprises measuring the pressure in the cylinder and opening the exhaust valve based on the pressure in the cylinder. The method includes where adjusting the exhaust valve opening timing of the cylinder occurs during a first cycle of the cylinder since a most recent engine stop. The method further comprises adjusting the exhaust valve opening timing of the cylinder during a second cycle of the cylinder since a most recent engine stop, the exhaust valve opening timing of the cylinder retarded during the second cycle of the cylinder as compared to the first cycle of the cylinder.

In some examples, the method of FIG. 6 provides for an engine operating method, comprising: initiating expansion stroke combustion in a cylinder of an engine for a first cycle of the cylinder since a most recent engine stop via a controller in response to a request to start an engine; adjusting an exhaust valve opening timing of a cylinder to a crankshaft angle at which an estimated pressure in the cylinder is within a predetermined pressure of a pressure in a crankcase of the engine during engine cranking via the controller; and cranking an engine in response to the engine start request. The method includes where initiating expansion stroke combustion in the cylinder includes directly injecting fuel to the cylinder and igniting the fuel while the engine is not rotating. The method further comprises engaging a starter a predetermined amount of time before igniting the fuel, where the predetermined time is a function of engine temperature, barometric pressure, fuel rail pressure, engine position, fuel rail temperature. The method includes where the predetermined amount of time is based on an amount of time it takes for a starter solenoid to travel from a position where a pinion gear is not engaged with a flywheel to a position where the pinion gear engages the flywheel. The method further comprises applying torque to the engine via the starter in response to igniting the fuel. The method includes where the fuel is ignited via a spark. The method includes where adjusting the exhaust valve opening timing includes adjusting the exhaust valve opening timing in response to a volume of the cylinder when the engine is stopped. The method includes where adjusting the exhaust valve opening timing includes adjusting the exhaust valve opening timing in response to an amount of time between when fuel injection ceases in a first cycle of the cylinder and a time when a spark is delivered to the cylinder during the first cycle of the cylinder.

In another representation, the method of FIG. 6 provides for an engine operating method, comprising: adjusting an exhaust valve opening timing of a cylinder of an engine to a crankshaft angle at which a pressure in the cylinder is expected to be substantially equal to a pressure in a crankcase of the engine during engine cranking via a controller in response to an engine start request, the pressure in the cylinder determined based on timing of spark delivered to the cylinder; and cranking an engine in response to the engine start request. The method includes where the spark is delivered to the cylinder before the engine begins to rotate. The method includes where the spark is delivered after fuel injection to the cylinder ceases. The method includes where the spark is delivered to the cylinder during an expansion stroke of the cylinder.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, at least a portion of the described actions, operations and/or functions may graphically represent code to be programmed into non-transitory memory of the computer readable storage medium in the control system. The control actions may also transform the operating state of one or more sensors or actuators in the physical world when the described actions are carried out by executing the instructions in a system including the various engine hardware components in combination with one or more controllers.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A vehicle system, comprising:

an engine; and a controller including executable instructions stored in non-transitory memory to adjust an exhaust valve opening timing of a cylinder of the engine to a crankshaft angle at which a pressure in the cylinder is expected to be within a predetermined pressure of a pressure in a crankcase of the engine when combustion does not occur in the cylinder before a first exhaust stroke of the cylinder after a most recent engine stop.

2. The vehicle system of claim 1, further comprising additional instructions to crank the engine via an electric machine.

3. The vehicle system of claim 2, further comprising additional instructions to measure a pressure in the crankcase.

4. The vehicle system of claim 1, further comprising additional instructions to estimate the pressure in the crankcase.

5. An engine operating method, comprising:

adjusting an exhaust valve opening timing of a cylinder of an engine to a crankshaft angle at which a pressure in the cylinder is within a predetermined pressure of a pressure in a crankcase of the engine during engine cranking via a controller in response to an engine start request; and cranking an engine in response to the engine start request.

6. The method of claim 5, where the predetermined pressure is a pressure within ten percent of the pressure in the crankcase.

7. The method of claim 5, where the engine is cranked via a starter motor.

8. The method of claim 7, where the starter motor engages the engine within a predetermined amount of time of delivering a first spark to the cylinder since a most recent engine stop.

9. The method of claim 5, where the engine is cranked via an integrated starter/generator or a driveline clutch.

10. The method as claimed in claim 5, further comprising measuring the pressure in the cylinder and opening the exhaust valve based on the pressure in the cylinder.

11. The method of claim 5, where adjusting the exhaust valve opening timing of the cylinder occurs during a first cycle of the cylinder since a most recent engine stop.

12. The method of claim 11, further comprising adjusting the exhaust valve opening timing of the cylinder during a second cycle of the cylinder since a most recent engine stop, the exhaust valve opening timing of the cylinder retarded during the second cycle of the cylinder as compared to the first cycle of the cylinder.

13. An engine operating method, comprising:

initiating expansion stroke combustion in a cylinder of an engine for a first cycle of the cylinder since a most recent engine stop via a controller in response to a request to start an engine;

adjusting an exhaust valve opening timing of a cylinder to a crankshaft angle at which an estimated pressure in the cylinder is within a predetermined pressure of a pressure in a crankcase of the engine during engine cranking via the controller; and cranking an engine in response to the engine start request.

14. The method of claim 13, where initiating expansion stroke combustion in the cylinder includes directly injecting fuel to the cylinder and igniting the fuel while the engine is not rotating.

15. The method of claim 13, further comprising engaging a starter or other cranking device a predetermined amount of time before or after igniting the fuel.

16. The method of claim 15, where the predetermined amount of time is based on an amount of time it takes for a starter solenoid to travel from a position where a pinion gear is not engaged with a flywheel to a position where the pinion gear engages the flywheel.

17. The method of claim 16, further comprising applying torque to the engine via the starter in response to igniting the fuel.

18. The method of claim 17, where the fuel is ignited via a spark.

19. The method of claim 13, where adjusting the exhaust valve opening timing includes adjusting the exhaust valve opening timing in response to a volume of the cylinder or piston position when the engine is stopped.

20. The method of claim 13, where adjusting the exhaust valve opening timing includes adjusting the exhaust valve opening timing in response to an amount of time between when fuel injection ceases in a first cycle of the cylinder and a time when a spark is delivered to the cylinder during the first cycle of the cylinder.

* * * * *